US005878710A

United States Patent [19]

Ritter et al.

[11] Patent Number: 5,878,710

[45] Date of Patent: Mar. 9, 1999

[54] FUEL INJECTION SHUTDOWN SYSTEM

[75] Inventors: Albrecht M. Ritter, Lafayette, Ind.; Robert L. Miller; T. Pin Shyu, both of Dunlap, Ill.; Steven E. Wilder, Lafayette, Ind.; Glenn B. Cox, Peoria, Ill.

[73] Assignee: Caterpillar Inc., Peoria, Ill.

[21] Appl. No.: 119,293

[22] Filed: Jul. 20, 1998

[51] Int. Cl.[6] ..... F02B 77/00

[52] U.S. Cl. ..... 123/198 DB; 123/198 D; 123/508

[58] Field of Search ..... 123/198 DB, 198 D, 123/507, 508, 198 F, 90.16, 90.48

[56] References Cited

U.S. PATENT DOCUMENTS

| | | | |
|---|---|---|---|
| 1,949,470 | 3/1934 | Hesselman | 123/508 |
| 3,638,628 | 2/1972 | Stolworthy | 123/198 DB |
| 4,020,814 | 5/1977 | Hewitt et al. | 123/198 DB |
| 4,071,010 | 1/1978 | Miller | 123/198 F |
| 4,080,946 | 3/1978 | Cunningham | 123/198 DB |
| 4,419,977 | 12/1983 | Hillebrand | 123/508 |
| 4,522,569 | 6/1985 | Taylor | 417/434 |
| 4,565,170 | 1/1986 | Grieshaber et al. | 123/359 |
| 4,597,369 | 7/1986 | Yasuhara | 123/458 |
| 4,630,588 | 12/1986 | Sagana et al. | 123/506 |
| 4,811,710 | 3/1989 | Schmitt et al. | 123/359 |
| 4,944,275 | 7/1990 | Perr | 123/508 |
| 5,020,493 | 6/1991 | Brunel | 123/198 DB |
| 5,295,470 | 3/1994 | Straubel | 123/458 |
| 5,402,764 | 4/1995 | Rossignol et al. | 123/508 |

*Primary Examiner*—Henry C. Yuen
*Assistant Examiner*—Hai Huynh
*Attorney, Agent, or Firm*—Fred J. Baehr

[57] ABSTRACT

A fuel injection shutdown system for a fuel injected internal combustion engine having mechanical fuel injectors with a return spring and lifter bodies slidably disposed in lifter guides comprises a slot formed in the lifter guides to receive a hydraulic cartridge and a slot in the lifter bodies which registers with the slots in the lifter guides, but are longer, the hydraulic cartridge extends into the slots in the lifter bodies, as the lifter bodies are reciprocated by an injection cam and the hydraulic cartridge does not contact the slots in the lifter bodies and the hydraulic cartridges have a stop pin slidably disposed therein and have a hydraulic duct which when filled with pressurized hydraulic fluid causes the stop pin to extend from the hydraulic cartridge contact the top of the slot in the lifter body and hold the lifter body off the cam preventing the fuel injectors from injecting fuel into the engine in two engine revolutions and stopping the engine to prevent harm to the engine.

10 Claims, 3 Drawing Sheets

FUEL INJECTION SHUTDOWN SYSTEM

TECHNICAL FIELD

The invention relates to a fuel injection engine and more particularly to a diesel engine with a fuel injection shutdown system, which will shut off the fuel to each cylinder within two engine revolutions.

BACKGROUND ART

If a diesel engine loses its lubricating oil pressure or over speeds it is desirable to shut down the engine rapidly, preferably within one cycle in order to protect the engine bearings from major damage. U.S. Pat. No. 4,565,170 describes a device for shutting off the fuel supplied to the engine by utilizing a solenoid valve to shut off the fuel being supplied to the engine and activating an aspirating pump to remove fuel from the fuel manifold to shutdown the engine quickly.

DISCLOSURE OF THE INVENTION

Among the objects of this invention may be noted the provision of a fuel injection shutdown system which will shut down a fuel injected engine before a malfunction can cause major damage to the engine.

In general, a fuel injection shutdown system for a fuel injected internal combustion engine having a plurality of cylinders and a mechanical fuel injector with a injector return spring for each cylinder cooperatively associated with a fuel injection cam disposed on a camshaft and lifter bodies that are reciprocated in lifter guides to inject fuel into each cylinder upon each revolution of the injection camshaft when made in accordance with this invention comprises a slot disposed in each lifter guide and a slot disposed in each lifter body. A hydraulic cartridge is disposed to fit into the slot in the lifter guide and be fastened thereto. The hydraulic cartridge extends into the slot in the lifter body. The slot in the lifter body is longer than the slot in the lifter guide and is disposed to allow the lifter body to be reciprocated by the fuel injection cam without the cartridge contacting the bottom or top of the slot in the lifter body. The hydraulic cartridge has a stop pin slidably disposed therein. A fluid passage disposed in the cartridge, when supplied with pressurized hydraulic fluid, causes the stop pin to extend from the cartridge and contact the top of the slot in the lifter body. The extended stop pin holds the lifter body off the fuel injection cam, whereby fuel injected into the engine will be discontinued within two engine revolutions and the engine will shutdown.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

BEST MODE FOR CARRYING OUT THE INVENTION

Figure 1:
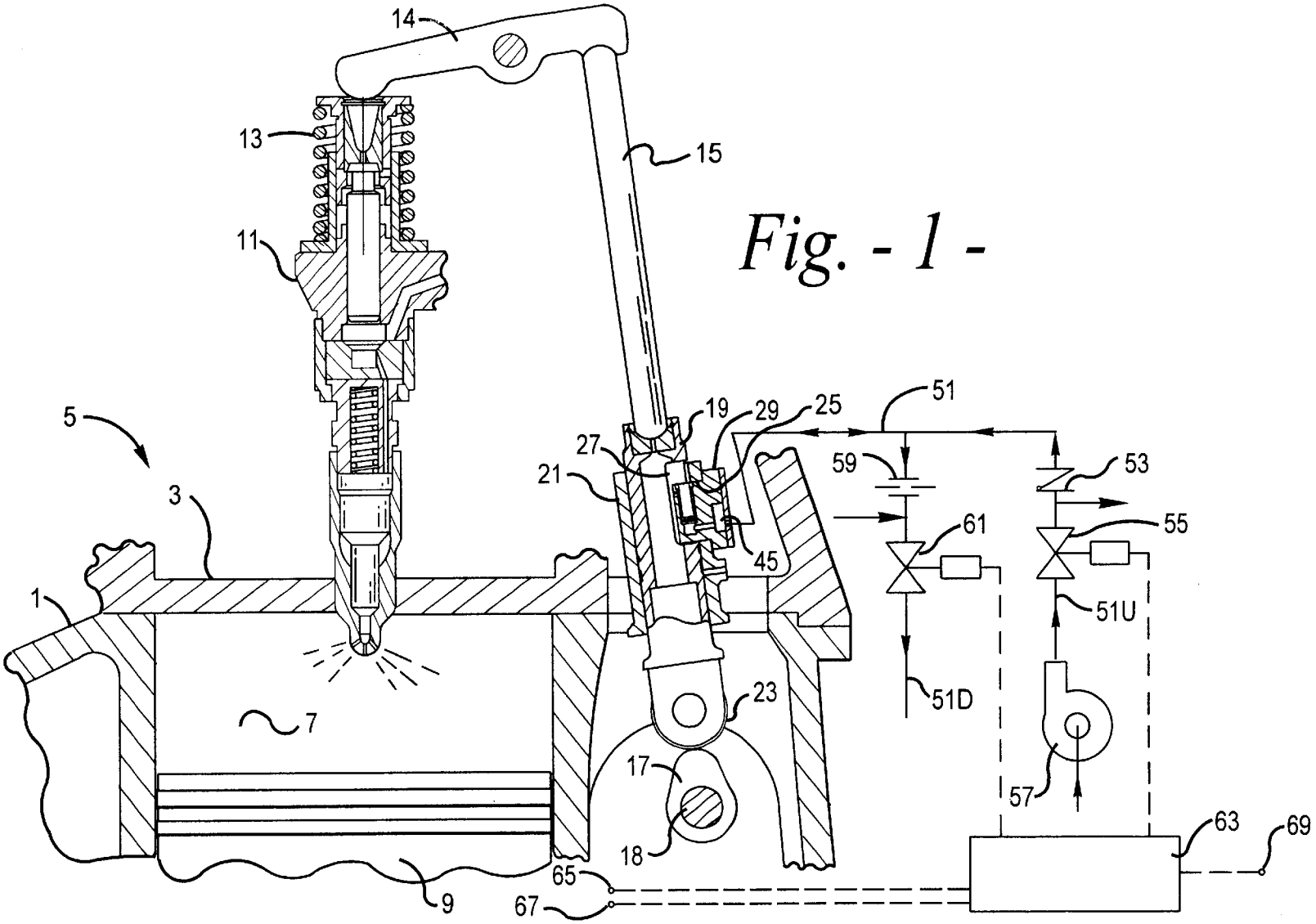
FIG. 1 is a partial sectional view of an engine block and head with a fuel injection shutdown system, the control portion is shown schematically.

Referring now to the drawings in detail and in particular to FIG. 1, there is shown a portion of an engine block 1 and a cylinder head 3 of a fuel injected internal combustion engine 5 such as a diesel engine 5. In the engine block 1 is shown a portion of a cylinder 7 and piston 9. A mechanical fuel injector 11 is disposed in the head 3 and extends into the cylinder 7 to inject the fuel. The fuel injector 11 has a return spring 13 that cooperates with a rocker arm 14 to bias a lifter rod 15 to engage a lifter body 19. The lifter body 19 engages a fuel injection cam 17 on fuel injection camshaft 18. The lifter body 19 is slidably disposed in a lifter guide 21 and has a cam follower roller 23 that engages the fuel injection cam 17 on the fuel injection camshaft 18. With each rotation of the fuel injection camshaft 18, the fuel injector 11 associated with each cylinder 7 injects fuel into the associated cylinder 7 in a predetermined order to run the fuel injected engine 5.

A fuel injection shutdown system that will stop supplying fuel to the engine 5 within one engine cycle or two revolutions of a four cycle engine comprises an elongated slot 25 disposed in each lifter guide 21 and an elongated slot 27 disposed in each lifter body 19. A hydraulic cartridge 29 is disposed to fit in the slot 25 in the lifter guide 21 and be fastened thereto by bolts or other fastening means (not shown) and to extend into the slot 27 in the lifter body 19. The slot 27 in the lifter body 19 is longer than the slot 25 in the lifter guide 21 and so disposed to allow the lifter body 19 to be reciprocated in the lifter guide 21 by the fuel injection cam 17 on the fuel injection camshaft 18 without the hydraulic cartridge 29 contacting the top or bottom of the slot 27.

Figure 2:
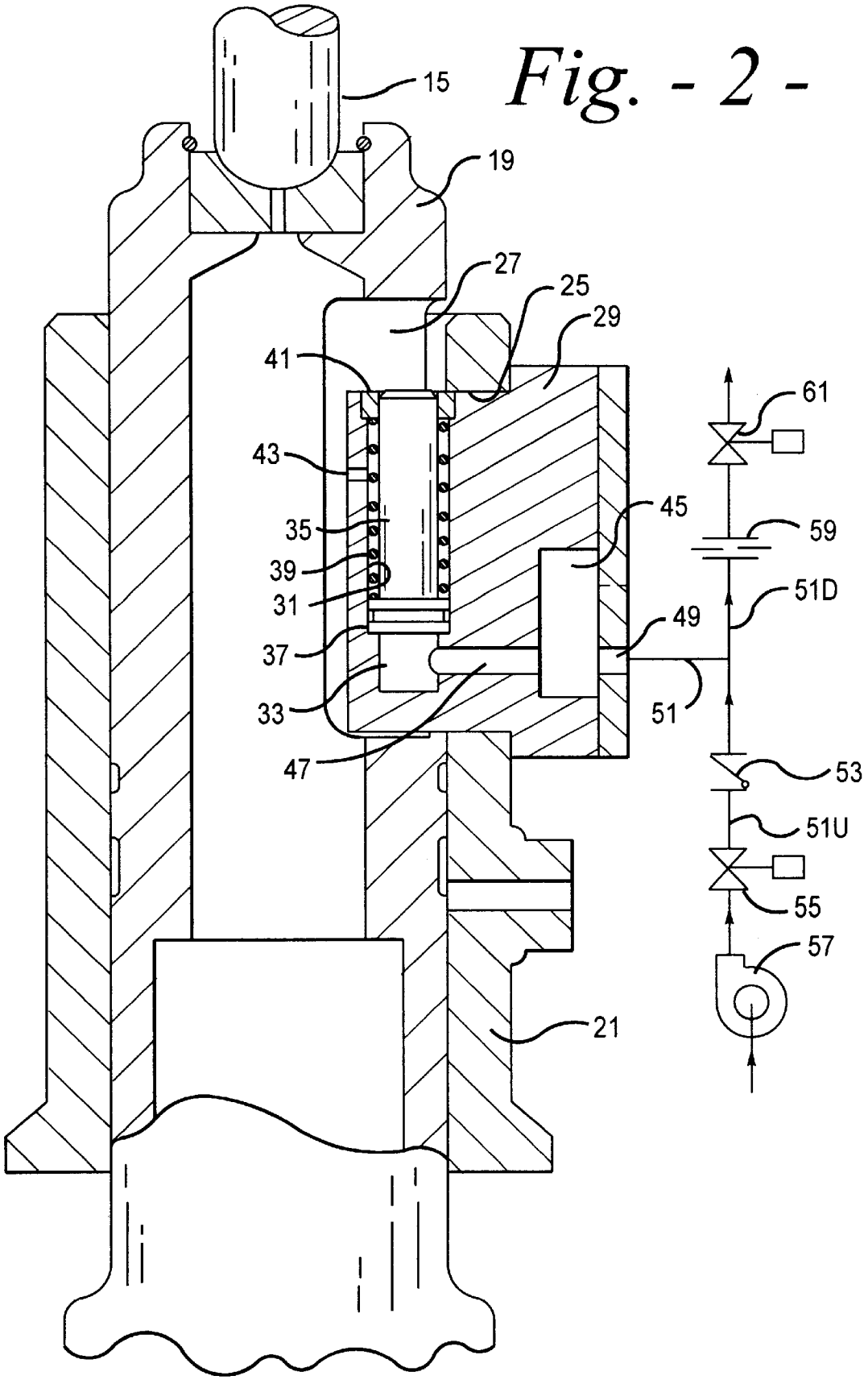
FIG. 2 is an enlarged partial sectional view of a fuel injection lifter body and lifter guide with a hydraulic cartridge having a stop pin in a normal run position.

Referring now to FIG. 2 the hydraulic cartridge 29 has a cylindrical opening 31 extending therein with a smaller diameter short lower portion 33. The cylindrical opening 31 is generally aligned with the slot 27 in the lifter body 19. A stop pin 35 is disposed in the cylindrical opening and has an enlarged lower portion 37 that forms a close sliding fit in the cylindrical opening 31. A spring 39 encircles the stop pin 35 and biases the stop pin 35 into the hydraulic cartridge 29. The spring 39 is held in place by a retainer ring 41 adjacent the open end of the cylindrical opening 31. The retainer is held in place by interlocking threads, a pressed fit or other means. The retainer ring 41 also provides a close fitting sliding bearing for the stop pin 35. A weep hole 43 is disposed adjacent the open end of the cylindrical opening 31 to prevent any oil which leaks into the cylindrical opening 31 from becoming trapped therein and inhibiting the movement of the stop pin 35. A hydraulic fluid accumulator 45 is disposed in the hydraulic cartridge 29 to damp pressure spikes during operation of the fuel injection shutdown system. The accumulator 45 is disposed in fluid communication with the lower portion 33 of the cylindrical opening 31 by a duct or passage 47 and has a port 49. The port 49 is disposed in fluid communication with a conduit 51, which is shown to have two branches. An up stream branch 51U has a check valve 53 adjacent the port 49, a supply solenoid valve 55 up stream of the check valve 53 and a pump 57 up stream of the solenoid valve 55. A down stream branch 51D has a bleed orifice 59 down stream of the port 49 and a bleed solenoid valve 61 down stream of the bleed orifice 59. While it is preferred to have the check valve 53 and bleed orifice 59 outside the hydraulic cartridge 29 they may be disposed within the cartridge 29. There is a separate check valve 53 and bleed orifice 59 for each cartridge while it is preferred to have a single supply and bleed solenoid valve 55 and 61 and a single pump 57. The stop pin 35 is shown in its normal position disposed wholly within the cartridge 29 allowing the lifter body 19 to be moved up and down by the fuel injection cam 17 to operate the fuel injector 11, to inject fuel into the cylinders 7 and to operate the engine 5.

Figure 3:
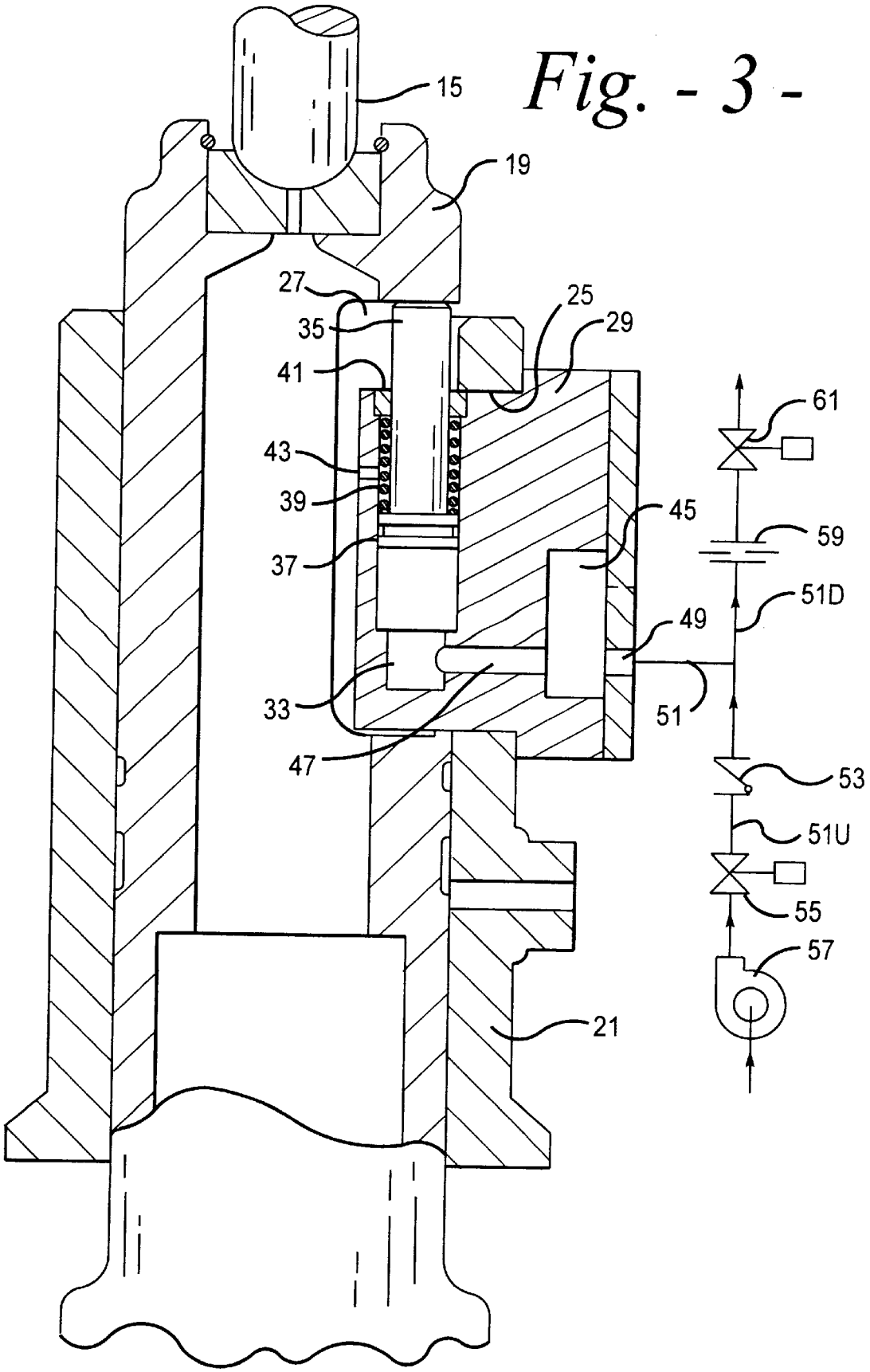
FIG. 3 is an enlarged partial sectional view of the fuel injection lifter body and lifter guide with the hydraulic cartridge having the stop pin in a stop position.

Referring now to FIG. 3 it is the same as FIG. 2 except the stop pin 35 is shown in its extended position contacting the top of the slot 27 in the lifter body 19 and holding the lifter body 19 off the fuel injection cam 17 thus preventing the fuel injector 11 from injecting fuel into the cylinder 7 stopping the engine 5.

Returning now to FIG. 1 and the operation of the fuel injection shutdown system, an electronic control module 63 receives signals from a plurality of engine sensors. When electronic control module 63 receives a signal from an engine sensor 65, which sends a signal indicating that there has been a loss of oil pressure or a signal from an engine sensor 67, which sends a signal indicating that the engine is over speeding or any other signal or combination of signals indicative of a engine condition which will result in major damage to the engine if it continues to run, the electronic control module 63 sends a signal to the supply solenoid 55 to open. When the supply solenoid 55 opens, the pressurized fluid from the pump 57 opens the check valve 53 supplying pressurized fluid to the hydraulic cartridge 29. The pressurized fluid biases the stop pin 35 upwardly overcoming the bias of the spring 39 encircling the stop pin 35. The stop pin 35 moves upwardly until it contacts the top of the slot 27. However, the pressure of the pressurized fluid supplied by the pump 57 is insufficient to overcome the bias of the injector return spring 13, so the stop pin 35 will only reach its full extension, if the lifter body 19 is being lifted by the injection cam 17. When the lifter body 19 begins to return under the bias of the injector return spring 13 the pressure in the hydraulic cartridge 29 builds up above the pressure supplied by the pump 57 and the check valve 53 closes. The trapped fluid in the hydraulic cartridge 29 increases in pressure to a pressure, which will equal the bias applied by the injector return spring 13 and hold the lifter body 19 at it maximum lifted position stopping the fuel injector 11 from injecting fuel into the cylinder 7. No fuel will be injected into any of the cylinders 7 after the injection camshaft 18 has made on revolution. To reset the fuel injection shutdown system a manual reset switch 69 is activated. This sends a signal to the electronic control module 63 to energize the solenoid valve 61 to open and allows the bleed orifice 59 associated with each hydraulic cartridge 29 to bleed down the fluid pressure in each hydraulic cartridge 29 at a controlled rate. A rate which will minimize the impact of the lifter body 19 reengaging the cam 17.

Lubricating oil is the preferred hydraulic fluid, it may come from and return to a separate reservoir or a crankcase (neither of which are shown). Preferably the check valves 53 open when the supply pressure is generally about 10 psi higher than the pressure within the hydraulic cartridge 29 and close when the pressure within the hydraulic cartridge 26 is generally about 15 psi above the supply pressure. The bleed orifices 59 are preferably capillary type orifices with very small diameter openings extending a relatively long distance.

While the preferred embodiments described herein set forth the best mode to practice this invention presently contemplated by the inventors, numerous modifications and adaptations of this invention will be apparent to others of ordinary skill in the art. Therefore, the embodiments are to be considered as illustrative and exemplary and it is understood that the claims are intended to cover such modifications and adaptations as they are considered to be within the spirit and scope of this invention.

INDUSTRIAL APPLICABILITY

A fuel injection shutdown system, when made in accordance with this invention advantageously provides a shutdown system that will shut down a loaded engine in two revolutions when the engine's electronic control module receives a signal indicating that there has been a loss of oil pressure, the engine is over heated or any other signal that is indicative of a engine condition which will result in major damage to the engine if it continues to run. Stopping the engine rapidly protects the engine from major damage and greatly reduces costs of repair and down time on the engine.

What is claimed is:

1. A fuel injection shutdown system for a fuel injected internal combustion engine having a plurality of cylinders and a mechanical fuel injector with a injector return spring for each cylinder cooperatively associated with a fuel injection cam disposed on a camshaft and lifter bodies that are reciprocated in lifter guides to inject fuel into each cylinder upon each revolution of the camshaft, the fuel injection shutdown system comprising a slot disposed in each lifter guide and a slot disposed in each lifter body, a hydraulic cartridge disposed to fit into the slot in the lifter guide and be fastened thereto and to extend into the slot in the lifter body, the slot in the lifter body being longer than the slot in the lifter guide and so disposed as to allow the lifter body to be reciprocated by the fuel injection cam without the cartridge contacting the bottom or top of the slot in the lifter body, the hydraulic cartridge having a stop pin slidably disposed therein and a fluid passage which when supplied with pressurized hydraulic fluid causes the stop pin to extend from the cartridge and contact the top of the slot in the lifter body and hold the lifter body off the fuel injection cam, whereby fuel injected into the engine will be discontinued within two engine revolutions and the engine will shutdown.

2. The fuel injection shutdown system as set forth in claim 1, further comprising a pump for supplying pressurized hydraulic fluid to the hydraulic cartridges, a valve for controlling the flow of pressurized hydraulic fluid to the hydraulic cartridges and a controller to open the valve when receiving signals from an engine sensor that indicates continued operation of the engine will damage the engine.

3. The fuel injection shutdown system as set forth in claim 2, further comprising a separate check valve disposed between the control valve and the stop pin in each hydraulic cartridge and the pressure of the pressurized hydraulic is high enough to move the stop pin against the top of the slot in the lifter body, but not sufficiently high to move the lifter body against the bias of the injector return spring, whereby the stop pin will only move to its fully extended position when the fuel injection cam moves the lifter body against the bias of the injector return spring and the lifter body will be held off of the fuel injection cam as the check valve will prevent the hydraulic fluid from flowing from the hydraulic cartridge and hold the stop pin in its fully extended position to prevent fuel from being injected within one revolution of the cam shaft shutting down the engine within two engine revolutions.

4. The fuel injection shutdown system as set forth in claim 3, further comprising a bleed orifice for each hydraulic cartridge and a bleed control valve which when opened allows each cartridge to relieve the pressure between the check valve and the stop pin and allow the stop pin to slowly return the lifter body in contact with the fuel injection cam to minimize the impact as they reengage.

5. The fuel injection shutdown system as set forth in claim 4, wherein the lifter body has a cam follower rotatably disposed on the end of the lifter body that contacts the fuel injection cam.

6. The fuel injection shutdown system as set forth in claim 5, wherein a cylindrical opening extends into the hydraulic cartridge and the stop pin has an enlarged end which slidably fits in the cylindrical opening, a spring biases the stop pin into the hydraulic cartridge and is held in place by a retainer disposed adjacent the open end of the cylindrical opening.

7. The fuel injection shutdown system as set forth in claim 6, wherein the hydraulic cartridge has a weep hole adjacent the open end of the cylindrical opening to prevent any oil that leaks into the cylindrical opening from becoming trapped therein.

8. The fuel injection shutdown system as set forth in claim 7, wherein the hydraulic cartridge has a hydraulic fluid accumulator disposed therein in fluid communication with the cylindrical opening and the pump.

9. The fuel injection shutdown system as set forth in claim 8, wherein the hydraulic fluid is lubricating oil.

10. The fuel injection shutdown system as set forth in claim 9, wherein the pump is separate from an engine lubricating oil pump.

* * * * *